US007225911B2

(12) United States Patent
Yokoi et al.

(10) Patent No.: US 7,225,911 B2
(45) Date of Patent: Jun. 5, 2007

(54) BILL HANDLING MACHINE

(75) Inventors: Toshinori Yokoi, Nagakute (JP); Riichi Kato, Nagoya (JP); Minoru Kadowaki, Toyota (JP); Atsuko Uozumi, Owarissahi (JP)

(73) Assignee: Hitachi, Ltd., Tokyo (JP)

( * ) Notice: Subject to any disclaimer, the term of this patent is extended or adjusted under 35 U.S.C. 154(b) by 108 days.

(21) Appl. No.: 10/885,700

(22) Filed: Jul. 8, 2004

(65) Prior Publication Data

US 2005/0056519 A1 Mar. 17, 2005

(30) Foreign Application Priority Data

Sep. 16, 2003 (JP) ..... 2003-323043

(51) Int. Cl.
*G07F 7/00* (2006.01)
*G07F 7/04* (2006.01)

(52) U.S. Cl. ..... 194/205; 194/206; 194/302; 209/534

(58) Field of Classification Search ..... 194/205, 194/206, 215, 216, 217, 302; 209/534
See application file for complete search history.

(56) References Cited

U.S. PATENT DOCUMENTS 4,681,229 A * 7/1987 Uesaka et al. ..... 209/534
4,726,474 A * 2/1988 Arikawa et al. ..... 209/534
5,173,590 A * 12/1992 Nakano et al. ..... 235/379
5,247,159 A * 9/1993 Yuge et al. ..... 235/379
5,900,607 A 5/1999 Awatsu et al.
6,006,209 A * 12/1999 Takeuchi et al. ..... 705/40
6,454,163 B2 * 9/2002 Peebles et al. ..... 235/379
6,811,016 B2 * 11/2004 Blair ..... 194/206
2002/0033359 A1 3/2002 Graef et al.

FOREIGN PATENT DOCUMENTS

JP 2002-367011 A 12/2002
JP 2003-21050 A 2/2003

* cited by examiner

*Primary Examiner*—Patrick Mackey
*Assistant Examiner*—Mark J. Beauchaine
(74) *Attorney, Agent, or Firm*—McDermott Will & Emery LLP

(57) ABSTRACT

A bill handling machine comprises a storing box for storing bills of plurality of different categories together, an instruction input unit for receiving a recovery instruction to recover bills belonging to a specific category among the categories, a sorter that in response to a the recovery instruction sorts out bills belonging to the specific category from among bills stored in the storing box, and a conveyor for feeding the bills from the storing box and, according to the results of the sorting, conveying bills of the specific category to a predetermined recovery unit.

22 Claims, 9 Drawing Sheets

| Mode | Category & Destination | | |
|---|---|---|---|
| Cash Count | Reject Note | → | Cash Slot |
| | Other | → | Temporary Stocker |
| Store Money | Genuine Note | → | Recycle Box |
| | Other | → | Reject Box |
| Cash Withdrawal | Genuine Note | → | Cash Slot |
| | Other | → | Temporary Stocker |
| Recovery | Genuine Note | → | Temporary Stocker |
| | Other | → | Cash Slot |

Fig.9

ADDRESS INFORMATION MANAGEMENT DATA

| | Temporary Stocker | ¥10,000 Box | ¥1,000 Box | Reject Box | Empty Address |
|---|---|---|---|---|---|
| nth bill | | | | | |
| ⋮ | | | | | |
| 2nd bill | 0002 | | | | |
| 1st bill | 0001 | | 0003 | | |

VALIDATION RESULT MANAGEMENT DATA

| Address | Denomination | Authenticity | Damaged/ Undamaged | Front/Back | Origin Information |
|---|---|---|---|---|---|
| 0001 | ¥10,000 | Genuine | Undamaged | Front | 0000001 |
| 0002 | ¥1,000 | Counterfeit | Undamaged | ? | 0000001 |
| 0003 | ¥10,000 | ? | Damaged | Back | 0000004 |
| | | | | | |

BILL HANDLING MACHINE

BACKGROUND OF THE INVENTION

1. Field of the Invention

The present invention relates to a bill handling machine that receives and dispenses bills or bank notes, and to a method of recovering bills stored in a bill handling machine.

2. Description of the Related Art

An automated teller machine (hereinafter ATM) used by users to deposit or withdraw money at a financial institution or the like incorporates a bill handling machine for receiving and dispensing bills. Bill handling machines include so-called recycling types, in which received bills are reused by being dispensed in other transactions. A bill handling machine of recycling type receives and dispenses bills by means of the following operations.

When receiving bills, the bill handling machine discriminates the denomination and authenticity of bills fed in from a cash slot, and calculates the deposited amount. Bills determined to be genuine are held in a temporary stocker, while other bills are returned to the cash slot. This operation will be referred to as "cash count." When the user subsequent confirms the deposited amount, the bill handling machine now places the bills, which had been held in the temporary stocker, into a holding box for recycling (hereinafter referred to as a "recycle box") provided for each denomination. In conjunction with this operation, the ATM notifies a host computer of the deposit amount, account information and the like. This operation will be referred to as "deposit storage" or "store money." During a withdrawal, bills corresponding to an indicated amount are fed to a cash-out slot from recycle boxes for the appropriate denominations.

Some bills supplied to a bill handling machine are not suitable for being recycled. Such bills would include, for example, severely damaged genuine notes, counterfeit notes, uncertain notes (unidentified notes) deemed to have uncertain authenticity during validation, and the like. When such a bill is discovered during cash count operation, the bill is returned to the cash slot. When such a bill is discovered during store money operation, the bill is recovered to a recovery box termed a "reject box," provided separately from the recycle boxes. Bills in the reject box are not recycled for subsequent use. The design and operation of a recycling type bill handling machine of the type described above is disclosed, for example, in JP2003-51050A.

Of bills stored in the reject box, uncertain notes are reexamined and subjected to more careful discrimination of authenticity at the financial institution. Since rejected bills stored in the reject box may include a combination of damaged bills (which, though damaged, are genuine), counterfeit bills, uncertain notes, all bills including damaged bills are reexamined leading to waste in the process.

To address this problem, it would be possible to employ a method whereby there is provided a dedicated storing box, separate from the reject box, for storing only those bills referred to as uncertain notes on the basis of the validation result during deposit. However, this poses the risk other problems, namely of larger size of the bill handling machine due to the additional storing box, or of an insufficient number of storage boxes within the bill handling machine due to assignment of existing storage boxes to dedicated use for uncertain notes.

Such problems are not limited to recycling type bill handling machines, but are common to non-recycling type bill handling machines, referred as cash dispensers (hereinafter CD machines). Furthermore, such problems are not limited to cases where uncertain notes are sorted out and recovered, but are common also to cases where bills of certain denomination are sorted out and recovered, or where damaged bills only are sorted out and recovered.

SUMMARY OF THE INVENTION

With the foregoing in view, the invention in one aspect thereof enables, in a bill handling machine, efficient sorting and recovery of bills of specified category from a storing box in which bills of multiple categories are present together.

According to an aspect of the present invention, there is provided a bill handling machine including a storing box in which bills of multiple categories are present together. The machine comprises: an instruction input unit, a bill sorter, and a conveyor. The term "category" refers to classification of a bill based on some predetermined criterion, for example, denomination category, authenticity category, extent of wear category, and so on. The instruction input unit receives an input of a recovery instruction to recover bills belonging to a certain specified category among these categories. A specified category targeted for recovery may be established in advance, or indicated in conjunction with the recovery instruction. The bill sorter, on the basis of this instruction, sorts bills belonging to the specified category, that is, determines on a bill-by-bill basis whether a bill belongs to the specified category. The conveyor feeds bills from the storing box and, according to the sorting result, conveys bills of specified category to a predetermined recovery unit. The term conveyor refers respectively to a conveying mechanism, such as a belt or rollers for conveying bills, and to the controller for controlling same. The recovery unit may utilize a storing box for bill recovery, a cash slot for inserting and dispensing bills, a temporary stocker for temporarily holding bills during the conveying process, and so on. According to the bill handling machine of the present invention, bills of predetermined category can be sorted out and recovered to a recovery unit from a storing box in which multiple categories of bills are present, without the need to provide a dedicated storing box for each category.

This sorting process may be reduced to practice in various ways. In a first embodiment, there may provided a bill validator for performing validation relating to bill category during the conveying process, with validation and sorting of bills being carried out during recovery. By so doing, the need for managing in advance validation results on a bill-by-bill basis for bills in the storing box is obviated. Also, bills can be sorted and recovered even where the storing box is of a type that cannot store bills in a methodical manner.

In a second embodiment, validation relating to bill category may be carried out on a bill that has been taken in by a specific insertion slot such as a cash slot or bill feed cassette. By storing in a memory the validation results associated in a bill-by-bill basis with bills stored in the storing box, it is possible for the bill sorter to refer to the memory when sorting. By so doing, the validation process during recovery may be dispensed with, making the sorting process simpler and more efficient.

Further, validation during recovery may be carried out through a combination of the first and second embodiments described above. The bill sorter can perform the bill sorting operation on the basis of stored validation result and validation result in the recovery process. By so doing, the accuracy of the sorting process can be improved.

In the second embodiment, information enabling identification of the depositor who has deposited an inserted bill may be stored in association with a validation result. When a user inserts money during a transaction such as a deposit, it is possible to use as such information the depositor's (i.e. user's) name or other identifying information; however, it is effective in terms of ease and reliability to identify on the basis of account number at the financial institution. Where an administrator inserted bills from a feed cassette, administrator name, financial institution name, or the like could also be used as the above information. Managing information identifying a depositor in association with bills in this way has the advantage of facilitating handling of any error that may occur in a deposit or withdrawal. Also, where uncertain notes or counterfeit bills are the designated category, the information can be used to identify the place of origin. For example, by identifying the date and depositor who has deposited a bill at issue, the information can be effectively put to use in identifying the introduction route or other link to a particular incident.

Bill sorting and recovery in the present invention can be realized, for example, by means of providing a plurality of bill conveyance destinations fed from the storing box, including the recovery unit, and switching among conveyance destinations on the basis of sorting results. Conveyance destinations may include a temporary stocker, for example.

As bill categories in the invention there may be established, on the basis of bill validation, genuine notes, counterfeit notes, and doubtful notes whose authenticity is uncertain; or the designated categories of doubtful notes only, or of doubtful notes and counterfeit notes. By so doing, non-genuine bills may be recovered efficiently, so that analysis thereof can be carried out efficiently. In the present invention, designated bill category may consist of a single category, or may designate as recovery targets bills of two or more kinds, such as counterfeit notes and doubtful notes, or 10,000 yen bills and 1,000 yen bills. Alternatively, bills that exclude certain categories may be established as designated categories.

In addition to the arrangements for a bill handling machine described above, the invention may also take the form of a control method for a bill handling machine. It may also take the form of a computer program for realizing the aforementioned control process in a bill handling machine, or a recording medium having a such a program recorded thereon. Here, recording media could include a flexible disk, CD-ROM, magneto-optical disk, IC card, ROM cartridge, punch card, printed matter imprinted with symbols such as a bar code, a computer internal storage device (memory such as ROM or RAM), an external storage device, or any of various other computer-readable media.

According to the invention, by validating bills and using the validation results, it is possible to efficiently sort and recover bills of specified category from a storing box in which bills of various kinds are present together.

BRIEF DESCRIPTION OF THE DRAWINGS

FIG. 9 illustrates contents of stocker data base 108A.

DESCRIPTION OF THE EMBODIMENTS

The following description of the embodiments of the invention is divided into the sections indicated hereinbelow.

Figure 1:
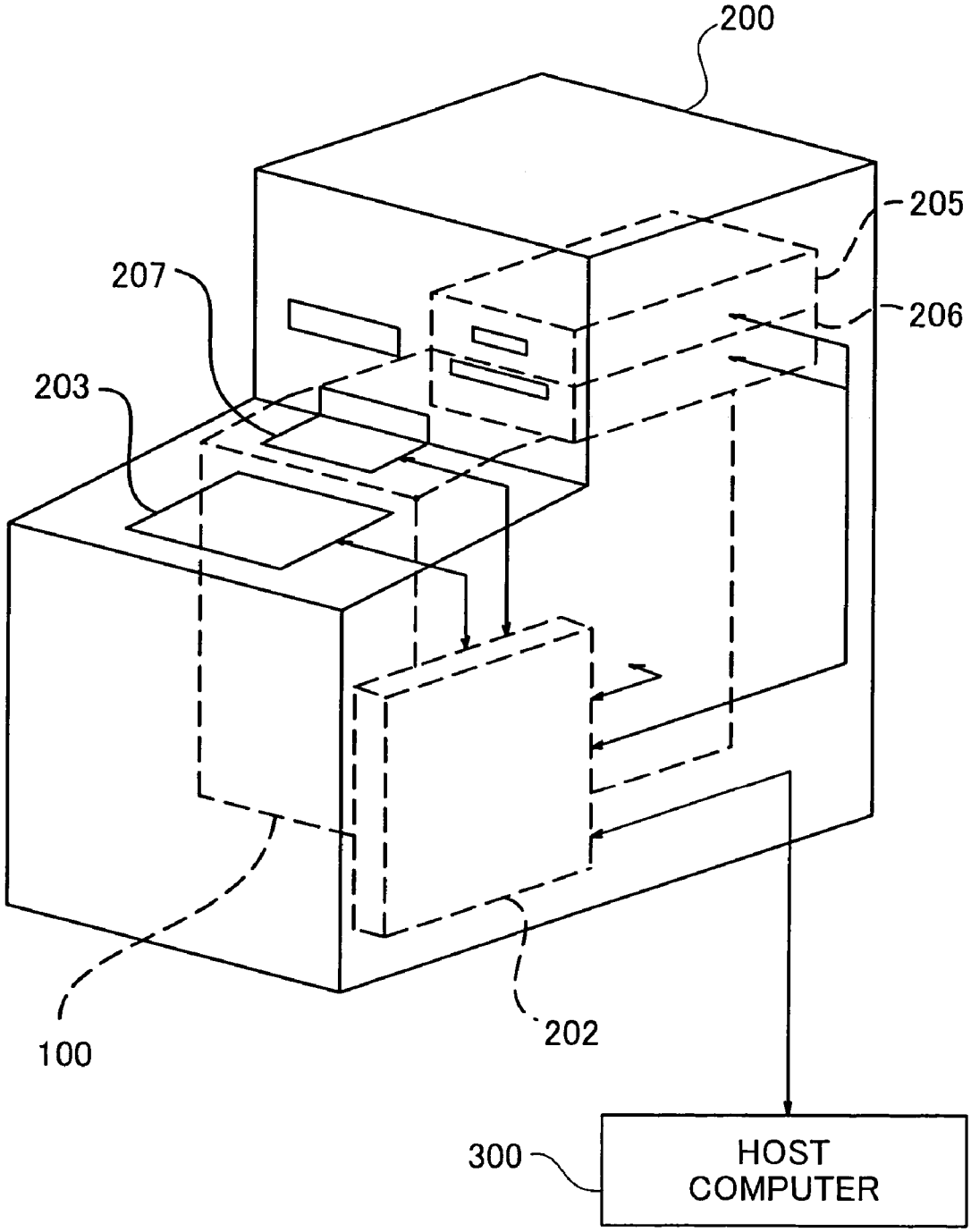
FIG. 1 illustrates a simplified arrangement of a cash automated teller machine 200 in a Embodiment of the invention.

A. Machine Arrangement:
A1. Overall Arrangement:
A2. Bill Handling Machine:
A3: Functional Blocks:
B. Deposit Control Process:
C. Recovery Process:
D. Embodiment 2:
D1. Machine Arrangement:
D2. Validation Result Database:
D3: Recovery Process:
E. Variations:

A. Machine Arrangement:

A1. Overall Arrangement:

FIG. 1 illustrates a simplified arrangement of a cash automated teller machine 200 embodying the present invention. Cash automated teller machine 200 is a machine located at a bank or the like, for carrying out unmanned deposit/withdrawal processes under user control.

The cash automated teller machine 200 (hereinafter ATM) of this Embodiment includes the following units. Card handling mechanism 205 has the function of reading information recorded on a magnetic stripe card known as an "ATM card." Information recorded on the card may include, for example, financial institution number, course, and user account number.

Console 203 serves as a user interface for displaying information for the purpose of deposit and withdrawal transactions, and for receiving inputs for deposit and withdrawal. In this Embodiment, a touch screen panel is used; however, a combination of a display and push button switches or the like could be used instead.

A cash transaction (cash deposit and/or withdrawal) with a user are carried out through a bill slot 207. Bill slot 207 may be composed of a slot for inserting bills and a slot for dispensing bills, separate from one another. When making a deposit, a bill inserted by a user into bill slot 207 is validated by bill handling machine 100, and stored classified according to its denomination. When making a withdrawal, bill handling machine 100 prepares bills according to the amount requested by the user, and dispenses these to the user from bill slot 207. An ATM receipt issuing unit 206 issues a receipt recording the details of the transaction.

In addition to these basic operating modes, the cash automated teller machine 200 of this Embodiment additionally has a recovery mode for use by an administrator at the financial institution. While described in detail later, in this recovery mode, the bill handling machine 100 identifies counterfeit and doubtful notes, and ejects them from bill slot 207.

The cash automated teller machine 200 is not limited to the exemplary arrangement described here, and may be provided with any of various other units. For example, in addition to the units mentioned above, there may be provided a unit for handling passbooks. Cards and passbooks are herein referred to collectively as "media," and card handling mechanism 205 and a unit for handling passbooks are referred to collectively as "media handling units."

Operation of each unit of the cash automated teller machine described hereinabove is controlled by a control unit 202. Control unit 202 is composed of a microprocessor with an internal CPU and memory. As indicated by the arrows in the drawing, control unit 202 exchanges information with the other units to control operation of the entire cash automated teller machine 200. Control unit 202 is connected to a host computer 300 by means of a communications line. By means of transmitting information pertaining to transactions to host computer 300, control unit 202 causes a process such as a deposit or withdrawal from a user's account to be carried out on the host computer 300 end. The control unit when executing a sort program to sort bills on the basis of validation results of the bill validator 126 and controlling conveyor 140 is referred to herein as the bill sorter.

Figure 2:
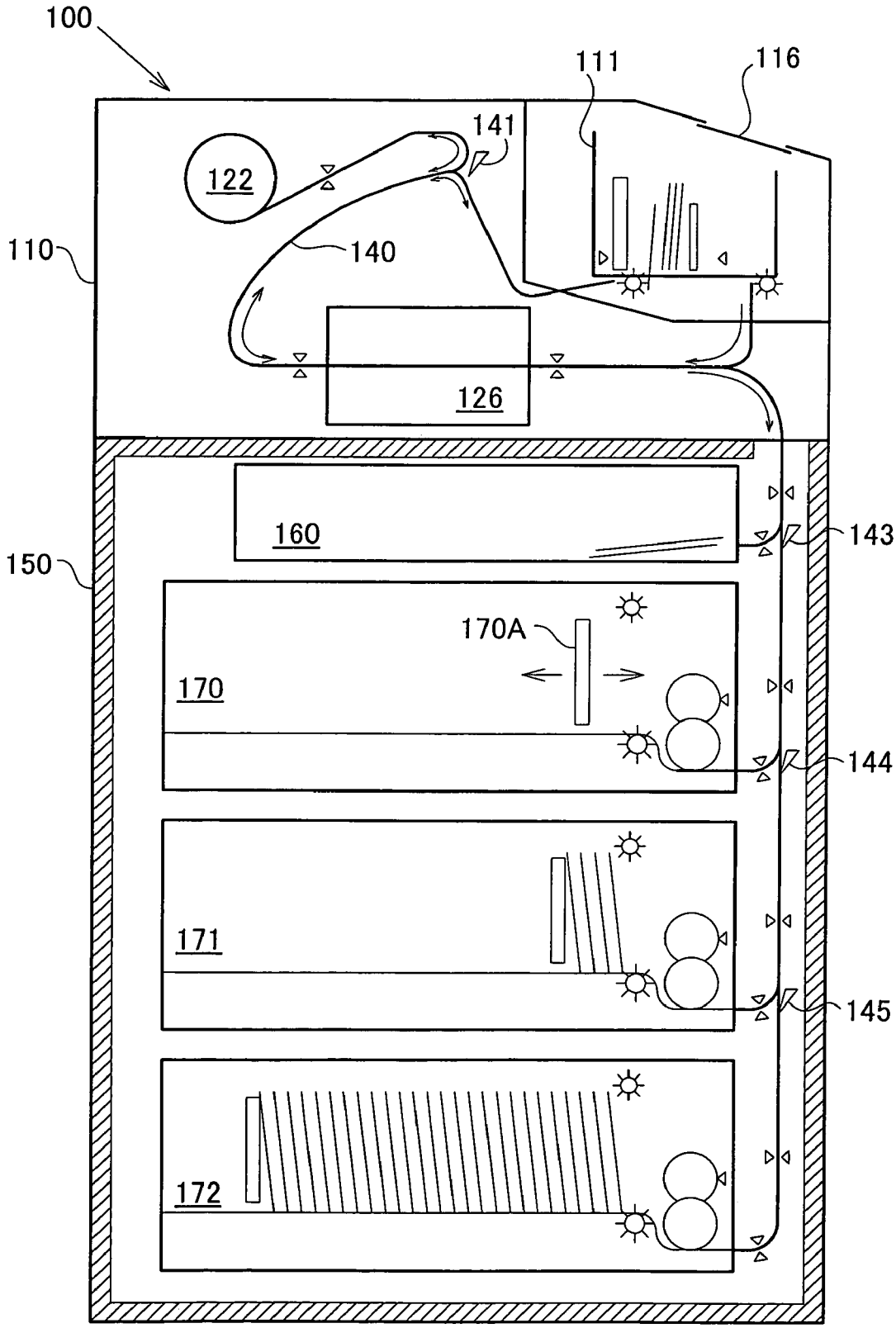
FIG. 2 is a side sectional view showing a simplified arrangement of a bill handling machine 100.

A2. Bill Handling Machine:

FIG. 2 is a side sectional view showing a simplified arrangement of a bill handling machine 100. Bill handling machine 100 is of so-called recycling type that reuses inserted bills in subsequent withdrawal transactions, and is composed of a cashbox unit 150 and an upper unit 110.

Cashbox unit 150 is sheathed with thick plates of metal so as to be of sturdy construction. Cashbox unit 150 comprises recycle boxes 170–172 for stocking genuine notes that are undamaged bills serviceable for withdrawals (hereinafter termed simply "genuine notes") and a reject box 160 for storing a combination of genuine notes that are severely damaged making them unsuitable for reuse (hereinafter termed "reject notes"), counterfeit notes, and doubtful notes whose authenticity is in doubt.

Denominations for stocking in recycle boxes 170–172 are determined in advance for each recycle box. In recycle box 170 is disposed a moveable press plate 170A for holding bills in an orderly fashion so as to avoid disarray in that the order in which bills are disposed within the box. Similar press plates are disposed in the other recycle boxes 171, 172 as well. In contrast to the recycle boxes, reject box 160 has a structure that, while not able to store bills in an orderly fashion, can feed them one at a time. Alternatively, a structure similar to that of the recycle boxes may be used in place of such a structure.

The structure of the upper unit 110 is as follows. Cash slot 111 is a slot for receiving bills from user and dispensing bills to users. A shutter 116 is disposed in the opening of cash slot 111. This shutter opens and closes automatically in conjunction with the bill slot 207 of the cash automated teller machine 200 described earlier.

Within the upper unit 110 is provided a temporary stocker 122 for temporarily stocking bills during the cash insertion or dispensing process. Temporary stocker 122 employs a reel system, i.e. a mechanism in which a belt winds around a rotating drum, as bills are held one at a time in the order in which they are conveyed by the belt. The temporary stocker 122 is not limited to a reel system; any of various mechanisms able to hold bills in the order in which they have been conveyed is possible.

Conveying of bills between cash slot 111 and the various stocker boxes is carried out by conveyor 140. Conveyor 140 uses conveyor mechanisms such as rollers, belts or the like in order to convey bills. Gates for switching bills among different destinations are disposed along the path of conveyor 140. Gate 141 performs switching between temporary stocker 122 and cash slot 111. Gate 143 switches the destination to the reject box 160. Gates 144 and 145 switch the destination to recycle boxes 170–172, respectively.

Gates are switched on the basis of validation results by a bill validator 126 disposed on the path of conveyor 140. Bill validator 126 employs an optical or other type of sensor to validate one at a time the denomination and authenticity of bills passing by it, and outputs the results. Validation may be carried out utilizing various kinds of information, such as image data obtained by scanning a bill, magnetic characteristics, optical characteristics under ultraviolet light, or the like.

While omitted from the illustration in FIG. 2, a control unit is provided within bill handling machine 100. The control unit is composed of a microprocessor with an internal CPU and memory, and controls operation of the bill handling machine 100 according to a program that has been prepared in advance.

Figure 3:
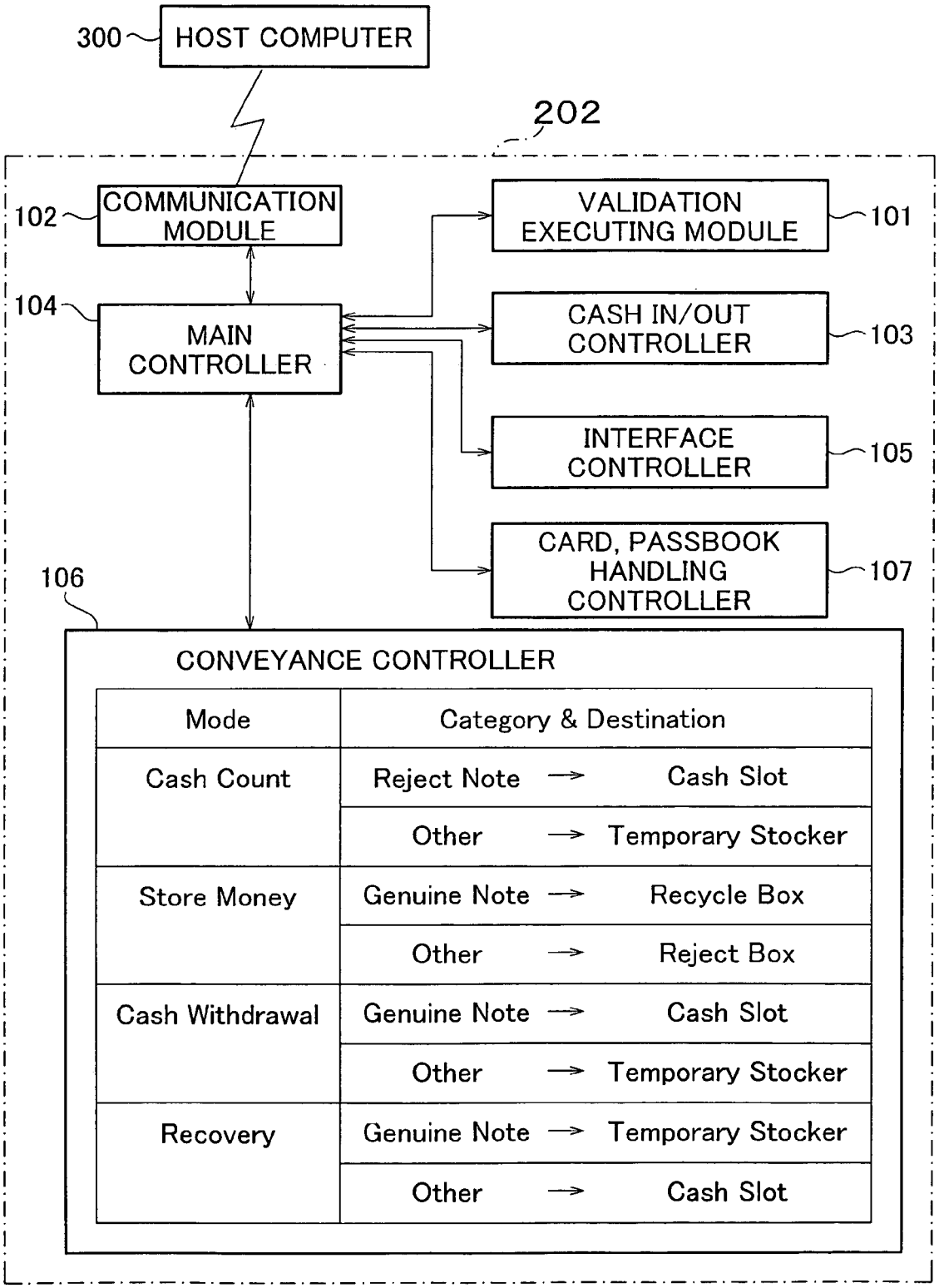
FIG. 3 illustrates functional blocks of ATM 200.

A3. Functional Blocks:

FIG. 3 illustrates functional blocks of ATM 200. Each functional block in the drawing is implemented by software executed by control unit 202. It is possible for these functional blocks to be implemented by hardware instead. At least some of these functions may be realized by the control unit disposed within bill handling machine 100. The functional blocks exhibit the functions hereinbelow, under control of the main controller 104.

Communication module 102 controls communication with the host computer 300. Validation executing module 101 employs the bill validator 126 to carry out validation of bills. Cash in/out controller 103 controls conveyance of bills when cash is deposited or dispensed. Card/passbook handling controller 107 inputs financial institution number, course, and user account number for the target transaction from an ATM card, passbook or the like, and records passbook entries.

Interface controller 105 performs screen display to console 203 and input of operations by a user or operator. Operations carried out by an operator include recovery mode execution instructions. In this Embodiment, the input of the execution instruction is carried out with console 203; however, another console for exclusive use by the operator may be provided on the back of the bill handling machine 100.

Conveyance controller 106 controls the entire bill conveying process, including storage of bills in the stocker, feed of bills from the stocker, gate switching, and the like. In order to achieve such control, conveyance controller 106 stores in memory associations of bill categories with particular destinations, for each of several modes. In FIG. 3, destinations used in the cash count mode, store money mode, cash withdrawal mode, and recovery mode are shown by way of example. Conveyor 140 includes a conveyor mechanism, gate 141, and conveyance controller 106.

Figure 4:
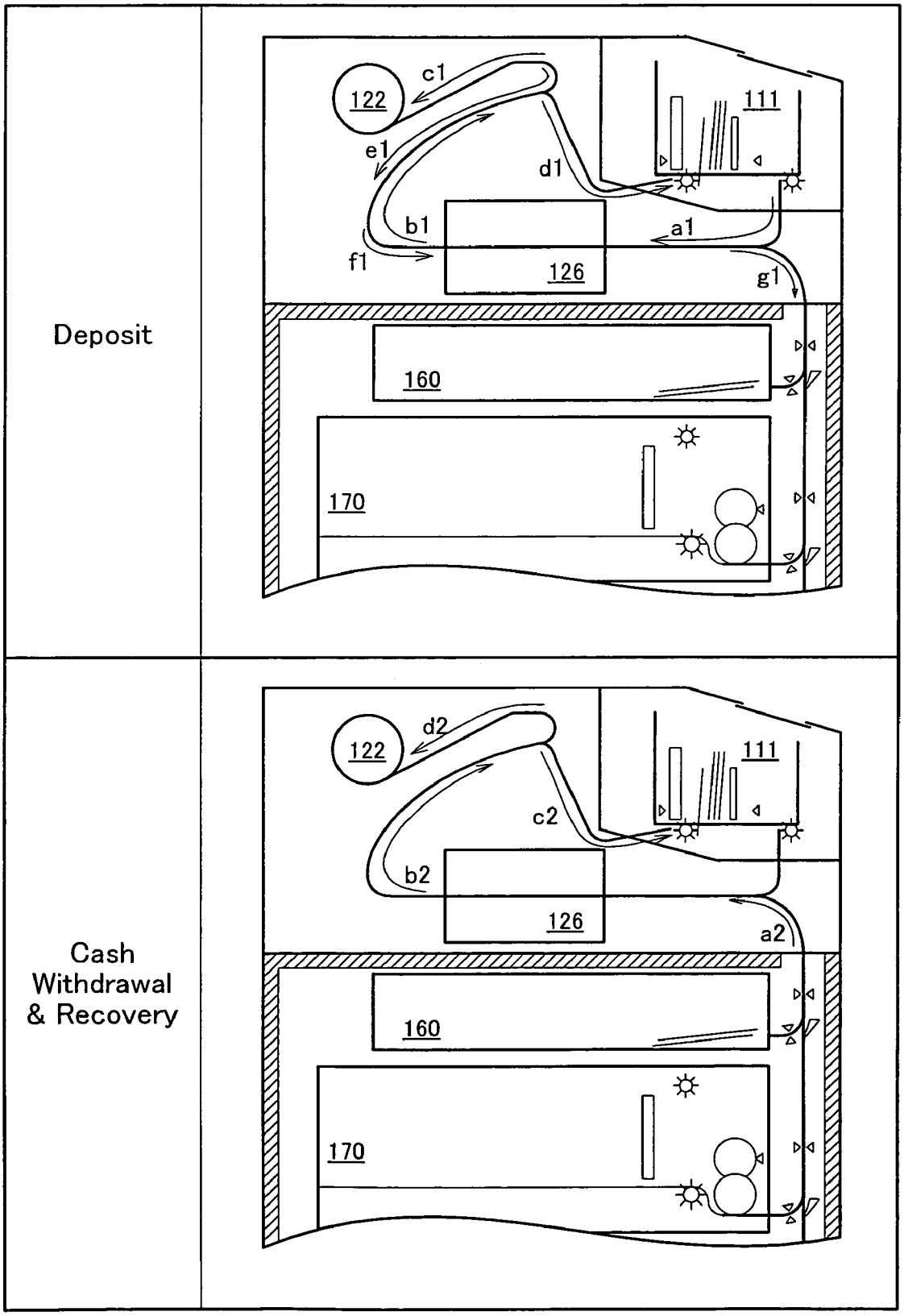
FIG. 4 illustrates operating modes of bill handling machine 100.

FIG. 4 illustrates operating modes of bill handling machine 100. In the upper half of the drawing is shown schematically the condition in which a bill is conveyed during a deposit; in the lower half of the drawing is shown schematically the condition in which a bill is conveyed during a cash withdrawal.

During a cash deposit, a bill inserted into cash slot 111, and as shown by arrows a1–c1, passes by the bill validator 126 where it is validated, and is then placed in temporary stocker 122. A bill determined by validation to be a reject bill is returned to the cash slot 111 as shown by arrow d1. In this example, counterfeit and doubtful notes are placed in temporary stocker 122. By means of the validation process, ATM 200 identifies the denomination and number of deposited bills, and calculates the total amount. The operation up to this point is referred to as "cash count" or "deposit tallying." To carry out conveyance in this manner, in the conveyance controller 106, the destination for reject notes is set to "cash slot," while the destination for other notes is set to the "temporary stocker" as shown in FIG. 3.

Next, once the user verifies the deposit amount displayed on the touch panel and makes a deposit instruction, the bill handling machine 100 feeds the bills from the temporary stocker 122 as indicated by arrows e1–g1, and stores the bills in the proper recycle boxes via the bill validator 126. This operation is called "store money" or "deposit storage." Counterfeit or uncertain notes that were being held in temporary stocker 122 are placed in the reject box 160. Bill validator 126 also performs validation of bills during deposit storage, and in the event that a reject note, counterfeit note or uncertain note is issued, also places such notes in the reject box 160. Genuine notes are placed in recycle boxes 170–172 according to their denomination. To carry out conveyance in this manner, in the conveyance controller 106, the destination for genuine notes is set to "recycle box," while the destination for other notes, i.e. reject notes, counterfeit notes and uncertain notes, is set to the "reject box" as shown in FIG. 3.

During a cash withdrawal, ATM 200 identifies denominations and number of bills to be dispensed according to a monetary amount specified by the user, and feeds bills from the recycle boxes. As indicated by arrows a2–c2 in the drawing, the bill is dispensed to cash slot 111 via bill validator 126. This operation is referred to as the "cash withdrawal process" or "cash dispensing process." Bill validator 126 also performs validation of bills during the cash dispensing process. In the event that a reject note, counterfeit note or uncertain note is discovered during this process, the bill is placed in temporary stocker 122 as indicated by arrow d2 in the drawing. By means of an operation analogous to that during deposit storage, once the cash dispensing process is completed, the bill in the temporary stocker 122 is again placed in the reject box 160. To carry out conveyance in this manner, in the conveyance controller 106, the destination for genuine notes is set to the "cash slot," while the destination for other notes is set to the "temporary stocker" as shown in FIG. 3.

Recovery is an operation that is executed in response to an instruction by the operator. Bill handling machine 100 feeds bills from the reject box 160—which has stored therein a combination of reject notes, counterfeit notes and uncertain notes—and performs validation thereof. For genuine notes, including reject notes, since these are not targeted for recovery, they are conveyed to temporary stocker 122 as indicated by arrows a2, b2, d2 in the drawing. Other bills, i.e., counterfeit notes and uncertain notes, being targeted for recovery, are conveyed to cash slot 111 as indicated by arrows a2–c2 in the drawing. For bills stored in the temporary stocker 122, by means of an operation analogous to that during deposit storage, these may again placed in the reject box. To carry out conveyance in this manner, in the conveyance controller 106, the destination for genuine notes (including reject notes) is set to the "temporary stocker," while the destination for other notes is set to the "cash slot" as shown in FIG. 3.

Recovery targets are not limited to the above example; various other settings are possible, such as targeting only uncertain notes (unidentified notes) for recovery. In this case, in the conveyance controller 106, the destination for "genuine and counterfeit notes" would be set to the "temporary stocker," while the destination for "uncertain notes" would be set to the "cash slot." It is also possible to target only counterfeit notes for recovery, in which case the destination for "genuine and uncertain notes" would be set to the "temporary stocker," while the destination for "counterfeit notes" would be set to the "cash slot." Where only reject notes are targeted for recovery, the destination for "uncertain and counterfeit notes" would be set to the "temporary stocker," while the destination for "reject notes" would be set to the "cash slot."

Figure 5:
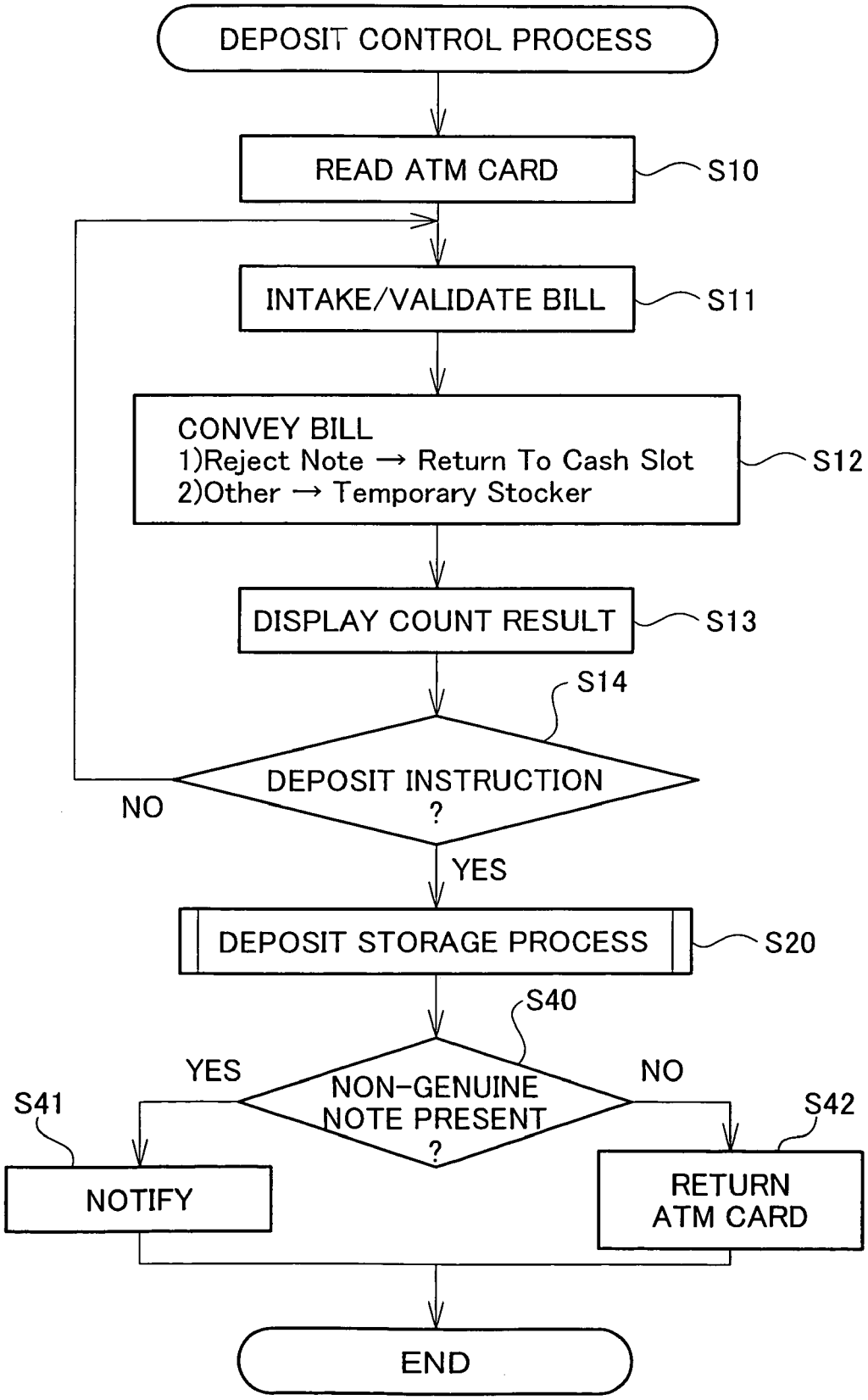
FIG. 5 is a flowchart of the deposit control process.

B. Deposit Control Process:

FIG. 5 is a flowchart of the deposit control process. This is a process that is executed by the control unit 202 when a user selects a cash transaction, such as "cash deposit" or "cash transfer." At least a part of the process may be realized with the control unit of the bill handling machine 100.

Once the process is initiated, control unit 202 reads in information required for the transaction, such as customer account number, from the ATM card (Step S10). Next, a bill is taken in through cash slot 111 and validated (Step S11). On the basis of the result, conveyance of the bill is controlled (Step S12). As noted in the preceding description, a reject note is returned to cash slot 111, whereas other notes are stored in temporary stocker 122. In conjunction with this process, the count result is displayed (Step S13). The process of Step S11–S13 is carried out repeatedly until the user makes a deposit instruction (Step S14).

When the user confirms the displayed amount and makes a deposit instruction (Step S14), the control unit performs the deposit storage process (Step S20). As described previously in FIG. 4, the bill is fed from temporary stocker 122 to either the reject box 160 or one of the recycle boxes 170–172.

In the above process, in the event that a counterfeit or uncertain note is discovered (Step S40), the control unit 202 notifies a pre-designated contact, such as a responsible individual at the financial institution, of this fact via the network or other line of communication (Step S41). Such notification enables rapid identification of a user who has inserted a counterfeit note or the like.

In the event that no counterfeit or uncertain note is discovered (Step S40), the control unit 202 returns the ATM card (Step S42) and completes the transaction. By delaying return of the ATM card until deposit storage is completed in this manner, the user can be compelled to remain at the ATM 200, enabling rapid response in the event that a counterfeit or uncertain note is discovered.

Figure 6:
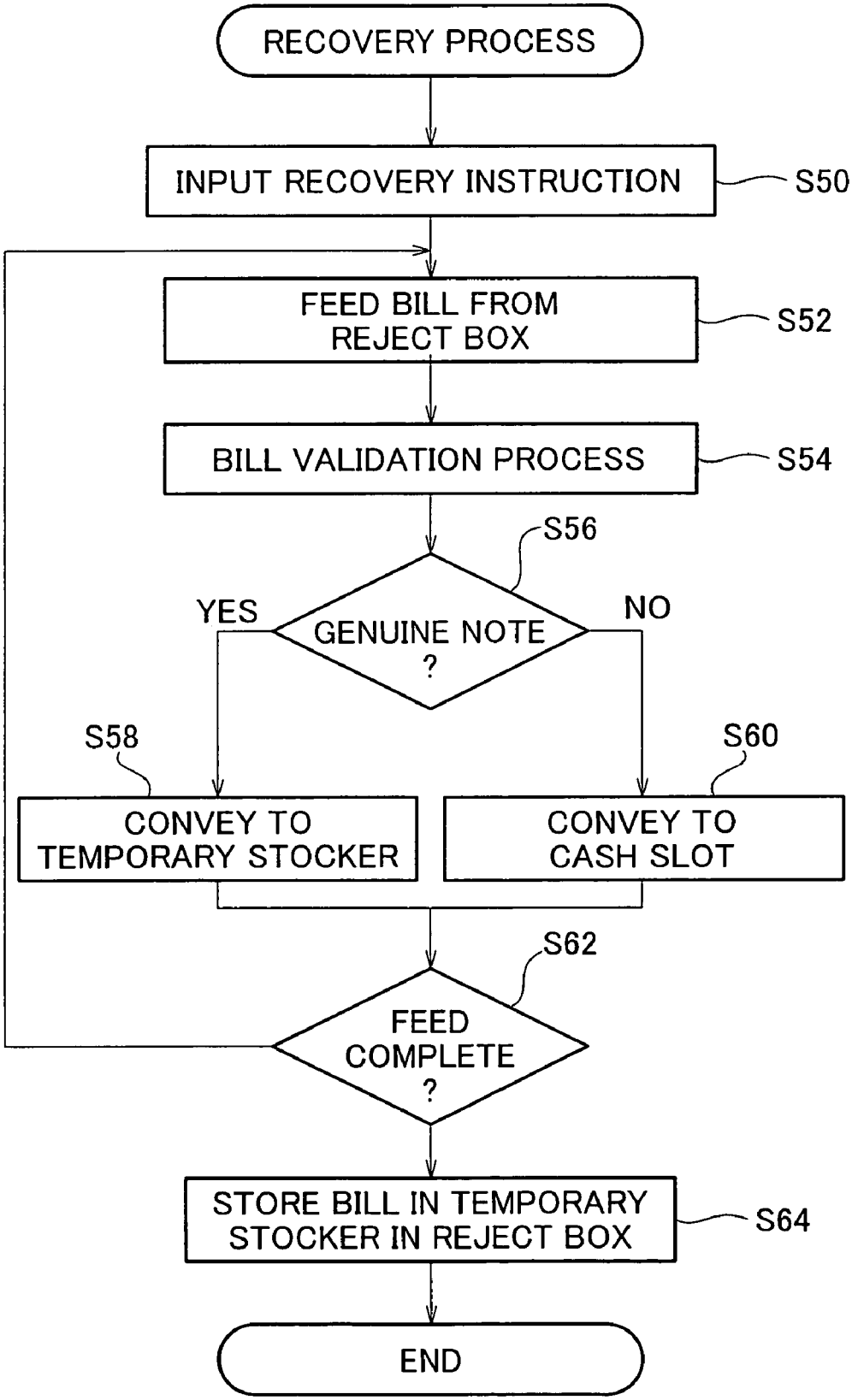
FIG. 6 is a flowchart of the recovery process.

C. Recovery Process:

FIG. 6 is a flowchart of the recovery process. This process is an instruction to sort out and recover counterfeit and uncertain notes from the request box, and is initiated by an operator instructing recovery mode through operation of the touch panel.

When the control unit receives a recovery instruction from the operator (Step S50), bills stored in the reject box 160 are fed one at time (Step S52) and subjected to a validation process of authenticity by the bill validator 126 (Step S54). Where the validated bill is a genuine note (including when it is a reject note), the decision is made that the bill is not a recovery target, and it is conveyed to the temporary stocker (Steps S56, S58). In the event that it is some other bill, i.e. a counterfeit or uncertain note, the decision is made that the bill is a recovery target, and it is conveyed to the cash slot 111 (Steps S56, 60).

The control unit repeats the above process for all notes stored in the reject box 160 (Step S62). The control unit then again stores the bills of temporary stocker 122 in reject box 160 (Step S64).

According to Embodiment 1 of the invention, by performing validation of each bill during recovery, counterfeit and uncertain notes can be efficiently sorted out and recovered from a reject box 160 having stored therein a combination of various kinds of bills. Since sorting and recovery of bills can be realized without the need to provide the bill handling machine 100 with a dedicate storing box for storing bills targeted for recovery, the machine can be kept smaller in size, with a simpler construction.

Figure 7:
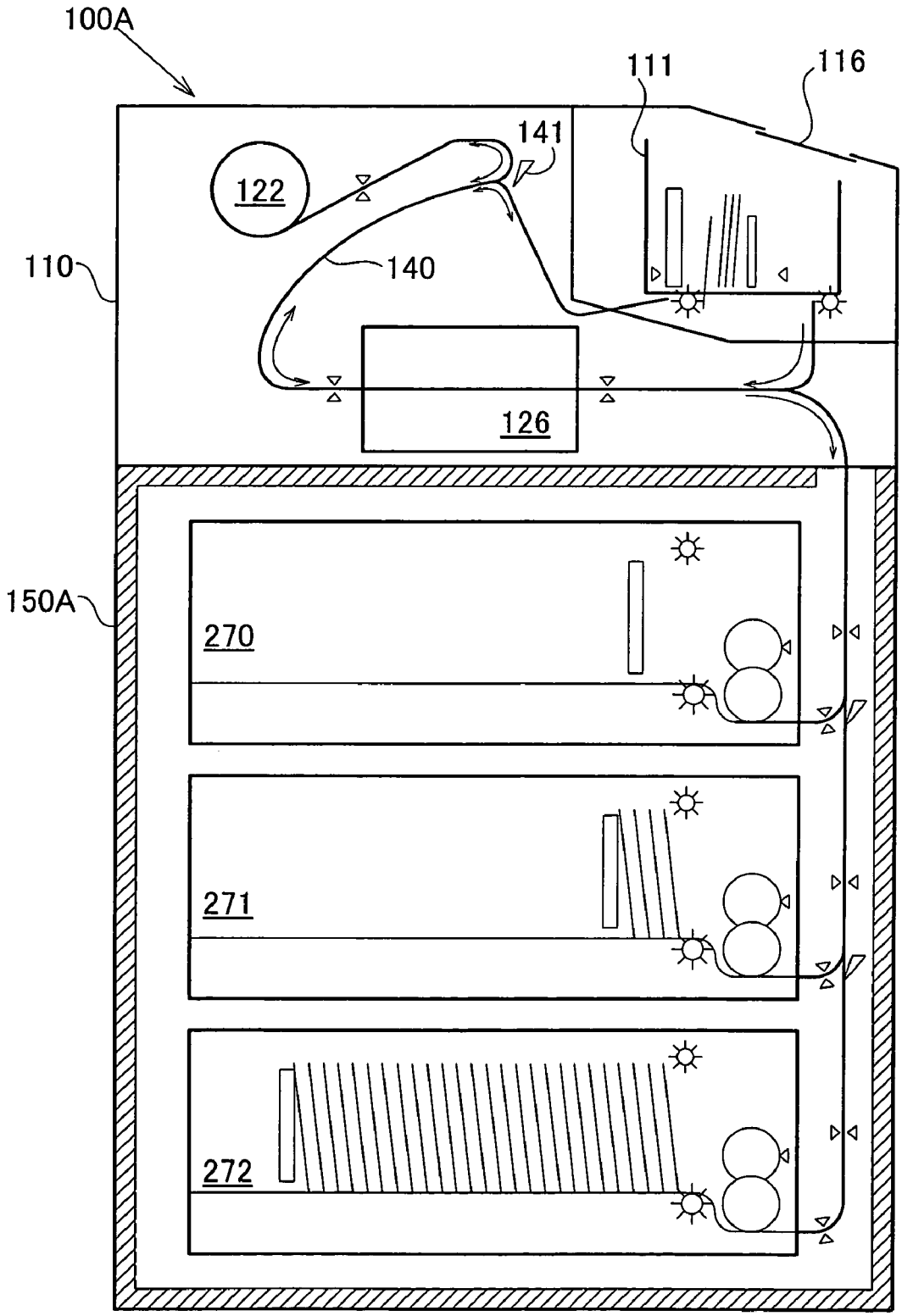
FIG. 7 is a side sectional view showing a simplified arrangement of a bill handling machine 100A of Embodiment 2.

D. Embodiment 2:

D1. Machine Arrangement:

FIG. 7 is a side sectional view showing a simplified arrangement of a bill handling machine 100A of Embodiment 2. Bill handling machine 100A differs from that of Embodiment 1 in terms of the structure of the cashbox unit 150A.

As storing boxes, cashbox unit 150A is provided with two recycle boxes 271, 272 and a reject box 270. Each of the storing boxes has construction similar to recycle boxes 170–172 in Embodiment 1, and is able to store bills in an orderly manner. The number of recycle boxes may be increased further.

Figure 8:
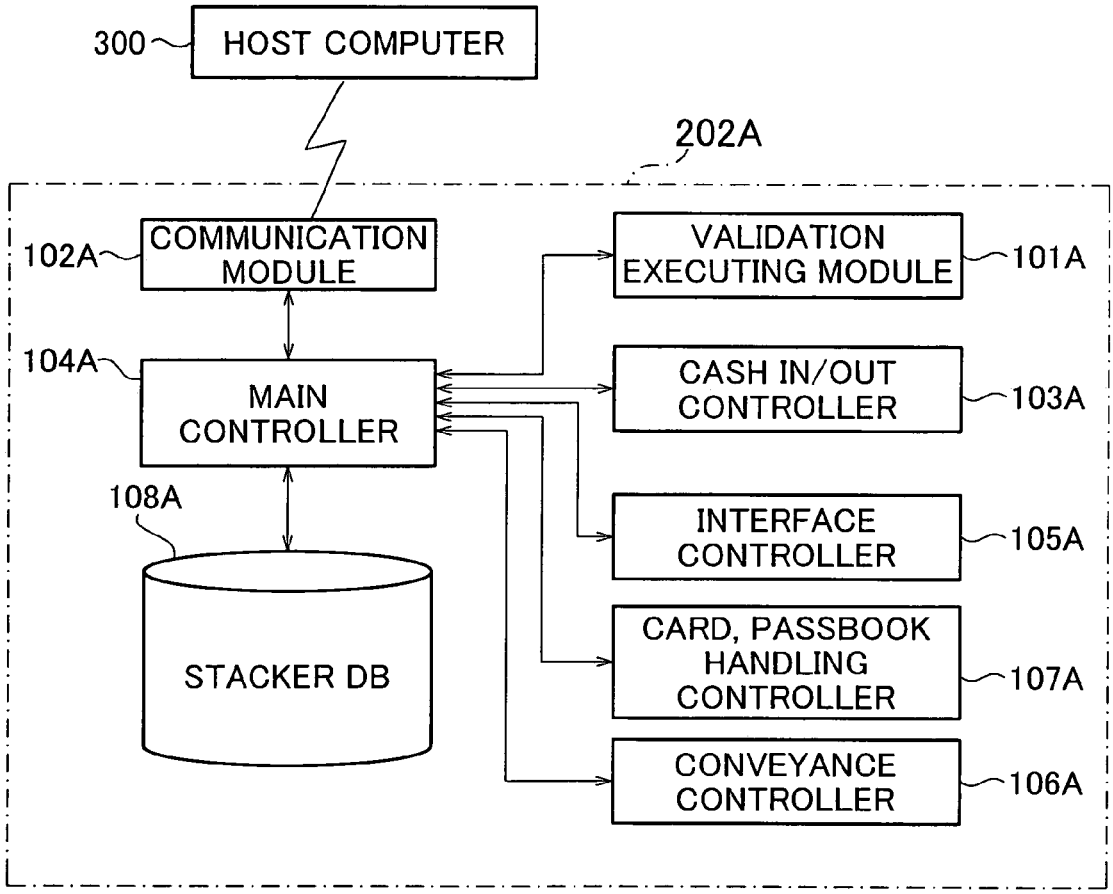
FIG. 8 illustrates functional blocks of ATM in Embodiment 2.

D2. Validation Result Database:

FIG. 8 illustrates functional blocks of ATM in Embodiment 2. As in Embodiment 1, each functional block is implemented by software executed by control unit 202A of the ATM. A stocker database 108A records, on a bill-by-bill basis, the origin, authenticity, etc., for bills stored in each stocker. Place of origin, authenticity, etc. for bills in the reject box 270 are recorded on a bill-by-bill basis as well.

Operation of other functional blocks 101A–107A is analogous to Embodiment 1 (see FIG. 2). Since in the course of the process access to stocker database 108A may take place as appropriate in some instances, a symbol different from that in Embodiment 1 has been assigned.

FIG. 9 illustrates contents of stocker database 108A. The database is composed of two kinds of data, i.e., address information management data and validation result management data. Address information management data is data wherein address information for the memory where validation results are stored is managed in association with each bill held in the temporary stocker 122, the recycle box that holds 10,000 yen notes (hereinafter 10,000 yen box) 271, the recycle box that holds 1,000 yen notes (hereinafter 1,000 yen box) 272, and the reject box 160. In the illustrated example, data associated with the first bill in temporary stocker 122 is stored at the address "0001." Here, the "first" bill means that the bill was the first to be conveyed into the stocker.

Since each stocker has construction whereby the bill conveyed in last is the first to be fed, address information management data is managed in stack form. That is, each time that a bill is conveyed into a stocker, the address storage area is incremented in the order "first bill, second bill . . . nth bill"; and each time that a bill is fed, address storage area is decremented in the order "nth bill . . . second bill, first bill." Address storage area is managed by means of a stack pointer for each stocker, i.e. data indicating how many bills are held in each stocker.

Also provided in the address information management data are empty address areas for managing information for empty address in which validation result management data was once stored and then deleted. While the concept of "first bill, second bill . . . nth bill" does not exist for an empty address area, in this Embodiment, these are managed in stack form analogously to the stockers, in order to simplify database structure.

Validation result management data represent validation results for each bill. In this Embodiment, denomination, authenticity, damaged/undamaged, front/back, and origin information are recorded as validation results. The origin information indicates the user who has inserted the bill, and includes the account number read from the ATM card during the deposit process in this Embodiment. Validation result management data stores this information for each individual bill. For example, in the illustrated example, there is stored in the memory area represented by address "0001" the information: "denomination=10,000 yen; authenticity=genuine; damaged/undamaged=undamaged; front/back=front; origin information=0000001." Here, for convenience in illustration, validation results to be stored are represented as text; however, data for each item may be encoded for storage.

In this Embodiment, the outputs "uncertain" or "indefinite" are permissible validation results. For example, let it be assumed that an inserted bill has sustained damage close to the acceptable limit beyond which it is no longer serviceable. Validation results for such a bill will unavoidably have some incertitude. Where bills are determined to be undamaged only when it has a level of damage sufficiently lower than the permissible range in order to avoid such incertitude, there is a risk that the proportion of reject notes will become unnecessarily high. Accordingly, in this Embodiment, in the event that the extent of damage is within a predetermined range close to the limit of the permissible range, the output "uncertain" is permissible as the damaged/undamaged parameter. In the illustrated example, items denoted by a mark "?" signify that these are uncertain. For example, a bill having a mark "?" for the authenticity parameter signifies that it is an uncertain note of uncertain authenticity.

Data management after a bill is conveyed is now described. As shown by way of example in the drawing, let it be assumed that the first bill and second bill of temporary stocker 122 and the first bill of 1,000 yen box 272 are being held. As described previously, 1,000 yen box 272 for each bill are stored in memory areas corresponding to addresses indicated by the address information management data.

In this state, let it be assumed that bills are fed in order from the temporary stocker. Assume that the second bill in temporary stocker is conveyed to the reject box, and the first bill in temporary stocker is conveyed to 10,000 yen box 271. In association with this conveyance, in the address information management data, the address information "0002" that was stored in the second bill area of the temporary stocker is now moved to the first bill area of the reject box. The address information "0001" that was stored in the first bill area of the temporary stocker is now moved to the first bill area of the 10,000 yen box.

Next, let it be assumed that a bill is dispensed from the 1,000 yen box 272. When cash is dispensed, in contrast to the case of movement between stockers, management of validation results is not necessary. Accordingly, data stored at address "0003" corresponding to the dispensed bill is deleted from the validation result management data. In association therewith, in the address information management data, the empty address information "0003" is moved to the area for managing empty addresses.

In this way, in the validation result database of this Embodiment, by means of moving address information it is possible to manage validation results relatively easily in association with movement of bills among stockers, without moving validation results in their entirety. The validation result database is not limited to the arrangement described by way of example here, it being possible to implement any of various arrangements that enable management of validation results in association with bills in each stocker. It is also acceptable to have a fixed area associated with each bill in a stocker and to move the validation results data per se. In the event of double feed, i.e. overlapping bills being conveyed, the bills may be stored in a dedicated storing box for double feed, and data managed accordingly. In this Embodiment, there has been shown by way of example a mode in which validation results are managed in association with the sequence of bills in each stocker; however, validation results may be managed by some other method, provided that they are associated with the sequence of bills.

D3: Deposit Process and Recovery Process:

Control of the deposit process and recovery process in Embodiment 2 is executed according to the flowchart of Embodiment 1 (FIG. 5, FIG. 6). In Embodiment 2, in addition to the process of Embodiment 1, during the deposit process the validation results obtained in Step S11 in FIG. 5 are stored in stocker database 108A. By so doing, information such as whether a note is genuine, counterfeit or uncertain is stored in stocker database 108A in the format shown in FIG. 9.

During recovery, control unit 202A refers to stocker database 108A, in place of the validation process in Step S54 of FIG. 6. By so doing, control unit 202A can identify the category, i.e. genuine note, counterfeit note or uncertain note, to which each bill belongs.

According to Embodiment 2, a counterfeit note can be sorted out and recovered utilizing the validation results at the time of deposit. By so doing, a validation process at the time of recovery can be dispensed with, so that the recovery process can be carried out faster. Also, since in Embodiment 2 the origin of each individual note is recorded, a resultant advantage is that it is easy to identify the origin of a recovered note that is counterfeit or uncertain.

E. Variations:

(1) In Embodiment 1 and Embodiment 2, the example of a recycling type bill handling machine was given, but the invention is applicable also to non-recycling type bill handling machines. For example, in a cash automated teller machine of a type known as a CD machine, all deposited bill are stored in a dedicated deposit storing box regardless of denomination or authenticity category. By treating such a dedicated deposit storing box as corresponding to the reject box in the Embodiments, it is possible to sort out and recover counterfeit notes and uncertain notes from the dedicated deposit storing box.

(2) Bills targeted for recovery are not limited to counterfeit notes and uncertain notes, it being possible to establish targets based on other categories. For example, bills of specified denomination could be targeted for recovery. Recovery targets could also be specified on the basis of front/back status during storage.

(3) Recovery targets need not be fixed in advance, but may instead be designated by the operator. For example, there could be employed a method whereby a menu for designating bills as recovery targets is provided on a menu screen that enables an operator to make recovery instructions. Bills targeted for recovery may be designated each time that recovery is carried out, or established in advance.

While the invention has been shown hereinabove through various Embodiments, the invention is not limited thereto and may take various other arrangements without departing from the scope and spirit thereof. For example, the control process hereinabove could be realized through software, or instead realized through hardware.

The present application claims priority from Japanese Patent Application JP2003-323043 filed on Sep. 16, 2003, the content of which is hereby incorporated by reference into this application.

What is claimed is:

1. A bill handling machine comprising:

a cash slot configured to receive and dispense bills;

a reject box configured to store bills of a plurality of categories together which are unsuitable for dispensing;

an operation unit configured to receive a recovery instruction to recover bills belonging to a specific category among the plurality of categories;

a sorter configured to sort out bills belonging to the specific category from among bills stored in the reject box in response to the recovery instruction; and a conveyor configured to convey bills of the specific category from the reject box to the cash slot according to the sorting by the sorter.

2. A bill handling machine according to claim 1, further comprising a bill validator configured to validate bills, wherein the sorter performs the sorting according to the validation.

3. A bill handling machine according to claim 1, further comprising:

a bill validator configured to validate bills; and a memory configured to store a result of the validation for each bill stored in the reject box, wherein the sorter performs the sorting while referring to the memory.

4. A bill handling machine according to claim 3, wherein the memory stores origin information for each bill in association with the result of the validation.

5. A bill handling machine according to claim 4, further comprising a medium handling unit configured to read information from an information storage medium provided from a user of the bill handling machine;

wherein the origin information includes an account number acquired from the information storage medium by the medium handling unit.

6. A bill handling machine according to claim 1, wherein the plurality of categories include a reject bill category and an unidentified bill category.

7. A bills handling machine according to claim 1, wherein the plurality of categories include at least two categories selected from an unidentified bill, a counterfeit bill, and a reject bill.

8. A bill handling machine according to claim 7, further comprising:

a bill validator configured to validate bills, wherein the sorter performs the sorting according to the validation.

9. A bill handling machine according to claim 7, further comprising:

a bill validator configured to validate bills; and a memory configured to store a result of the validation for each bill stored in the reject box;

wherein the sorter performs the sorting while referring to the memory.

10. A bill handling machine according to claim 9, wherein the memory stores origin information for each bill in association with the result of the validation.

11. A bill handling machine according to claim 7, further comprising:

a temporary stocker configured to temporarily hold bills, wherein the conveyor conveys bills belonging to the specific category to the cash slot and conveys bills not belonging to the specific category to the temporary stocker according to the result of the sorting by the sorter.

12. A bill handling machine according to claim 1, further comprising:

a temporary stocker configured to temporarily hold bills, wherein the conveyor conveys bills belonging to the specific category to the cash slot and conveys bills not belonging to the specific category to the temporary stocker according to the result of the sorting by the sorter.

13. A method of controlling a bill handling machine, comprising the steps of:

receiving bills;

storing received bills of a plurality of categories together which are unsuitable for dispensing in a reject box;

receiving a recovery instruction to recover bills belonging to a specific category among the plurality of categories;

sorting out bills belonging to the specific category among bills stored in the reject box in response to the recovery instruction; and executing control to convey bills of the specific category from the reject box to a cash slot for dispensing bills according to the sorting by a sorter.

14. A method according to claim 13, wherein the plurality of categories include at least two categories selected from an unidentified bill, counterfeit bill, and a reject bill.

15. A method according to claim 13, wherein the step of sorting out bills belonging to the specific category among bills stored in the reject box is executed based on a validation result of whether or not the bills belong to the specific category.

16. A recycling type bill handling machine comprising:

a cash slot for receiving and dispensing bills;

a temporary stocker configured to temporarily hold bills;

a recycle box configured to store bills suitable for dispensing among inserted bills;

a reject box configured to store bills of a first category and bills of a second category together, the reject box being disposed separately from the recycle box, the bills of the first category including bills unsuitable for dispensing among received bills;

an operation unit configured to receive a recovery instruction to recover the bills of the first category;

a conveyor configured to convey bills to the cash slot or to the temporary stocker; and a control unit configured to control the conveyor to feed the bills of the first category and the bills of the second category from the reject box according to the recovery instruction and to set the conveyance destination for the bills of the first category to the temporary stocker and to set the conveyance destination for the bills of the second category to the cash slot.

17. A recycling type bill handling machine according to claim 16 further comprising:

a bill validator configured to validate bills fed from the storing box, wherein the control unit sets the conveyance destinations for the bills of the first category and the bills of the second category based on a result of the validation.

18. A recycling type bill handling machine according to claim 16, further comprising:

a bill validator configured to validate bills; and a memory configured to store a validation result for each bill stored in the reject box, wherein the control unit sets the conveyance destinations for the bills of the first category and the bills of the second category based on the validation result stored in the memory.

19. A bill handling machine according to claim 16, wherein the first category bills include reject bills and the second category bills include unidentified bills.

20. A bill handling machine according to claim 16, wherein the first category bills include reject bills and the second category bills include counterfeit bills.

21. A bill handling machine according to claim 16, wherein the first category bills include unidentified bills and the second category bills include counterfeit bills.

22. A recycling type bill handling machine comprising:

a cash slot for receiving and dispensing bills;

a recycle box configured to store bills suitable for dispensing from among received bills;

a reject box configured to store bills of a plurality of categories together, the reject box being disposed separately from the recycle box, the bills of the plurality of categories being unsuitable for dispensing from among received bills; and a control unit configured to execute dispensing control to dispense bills from the recycle box to the cash slot and conveyance control to feed bills of a specific category from among bills of the plurality of categories stored in the reject box and convey the bills of the specific category to the cash slot.

* * * * *